United States Patent [19]

Fron

[11] 4,103,438

[45] Aug. 1, 1978

[54] PLASTIC FOOT PROTECTOR

[76] Inventor: Frode Fron, Damvegen 24 A, Krakeroy, 1600 Fredrikstad, Norway

[21] Appl. No.: 696,819

[22] Filed: Jun. 16, 1976

[30] Foreign Application Priority Data

| | | | |
|---|---|---|---|
| Jun. 20, 1975 | [NO] | Norway | 752194 |
| Feb. 4, 1976 | [NO] | Norway | 760364 |
| Feb. 4, 1976 | [NO] | Norway | 760365 |

[51] Int. Cl.[2] ..... A43B 13/22

[52] U.S. Cl. ..... 36/72 R; 36/77 R

[58] Field of Search ..... 36/72 R, 77 R, 85

[56] References Cited

U.S. PATENT DOCUMENTS

| | | | |
|---|---|---|---|
| 2,105,263 | 1/1938 | Reece et al. | 36/85 |
| 2,615,261 | 10/1952 | LaGrotto | 36/72 R |
| 3,841,004 | 10/1974 | Gray et al. | 36/72 R |

FOREIGN PATENT DOCUMENTS

| | | | |
|---|---|---|---|
| 694,810 | 9/1930 | France | 36/85 |
| 366,430 | 1/1923 | Fed. Rep. of Germany | 36/85 |
| 6,551 of | 1900 | United Kingdom | 36/85 |

*Primary Examiner*—Alfred R. Guest

*Attorney, Agent, or Firm*—Haseltine, Lake & Waters

[57] ABSTRACT

Foot protector for use in safety footwear, shaped of a plastic material that is adapted to the shape of the foot, and being preferably of the polycarbonate type. The protector comprises a toe cap and an instep cap, with a lower part that is shaped so as to be secured to the sole of the footwear, to prevent the foot protector from penetrating into the sole.

5 Claims, 7 Drawing Figures

PLASTIC FOOT PROTECTOR

FIELD OF THE INVENTION

The present invention relates to a foot protector made of plastic, in the shape of a toe, and an instep protector, suitable for use in safety footwear of different types.

BACKGROUND

It is known to use toe protectors as inserts in shoes for safety purposes. These protectors have heretofore been manufactured of metal, preferably steel. Certain requirements must be met by toe protectors regarding their mechanical strength. A toe protector, for safety purposes, must primarily meet certain requirements as to load and pressure tests. Due to the comparatively severe requirements as regards the mechanical strength of the toe protectors to be accepted for safety purposes, only steel has been regarded as a suitable material.

In previously known safety shoes, the toe protector made of steel is incorporated in the shoe in such a manner that it is placed beneath the material of the shoe upper. A considerable disadvantage of such safety shoes that comprise the toe protector is that only the toes of the foot are protected whereas the instep remains unprotected.

Another disadvantage of traditional toe protectors of steel is that upon extreme loads resulting in deformation of the toe protectors, they will remain in the deformed state. This causes great problems, such as when a safety shoe has to be removed from an injured foot after an accident.

SUMMARY OF THE INVENTION

It is therefore one of the major objects of the present invention to provide an improved foot protector, preferably made of plastic, instead of the hitherto used steel. A preferred plastic material is polycarbonate.

The foot protector according to the present invention has a considerably lower weight than a traditional toe protector made of steel. In spite of the fact that the foot protector is considerably larger and thicker than conventional protectors, the weight of a preferred embodiment of the inventive foot protector does not exceed the weight of a conventional steel toe protector. Usually it is lighter. Safety footwear comprising foot protectors according to the present invention are usually much lighter and feel more comfortable on the foot.

The foot protector according to the present invention meets the requirements as regards mechanical strength properties for being accepted for safety purposes.

Basically, two embodiments are suggested by the invention. According to one, the toe and the instep protector are made of one piece, and this type of foot protector is particularly suited for use as an upper of a safety clog. The invention consequently provides in its first embodiment a new type of safety clog.

According to the other embodiment, the protector consists of two parts, namely a toe cap and an instep cap, that are linked together or connected with each other in some conventional manner. The foot protector according to this embodiment is particularly suited for use in traditional safety footwear, such as for safety shoes, etc.

On working sites and elsewhere, clogs are used as footwear. On many working sites, however, there is a demand for safety shoes, and there has thus been a steady decrease in the use of clogs.

BRIEF DESCRIPTION OF THE DRAWING

The objects, important features and advantages of the inventive foot protectors will be better understood by reference to the following detailed description, when considered with the accompanying drawings, wherein.

DETAILED DESCRIPTION

Figure 1:
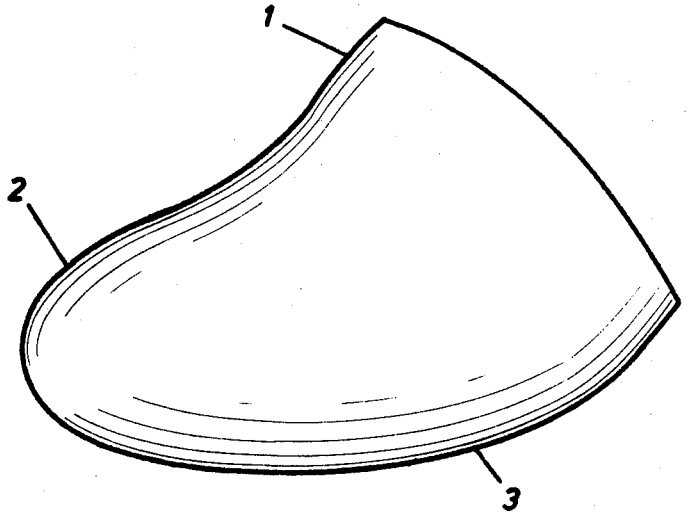
FIG. 1 is an exemplary toe and instep protector that is suited for use as an upper of a clog.
Figure 2:
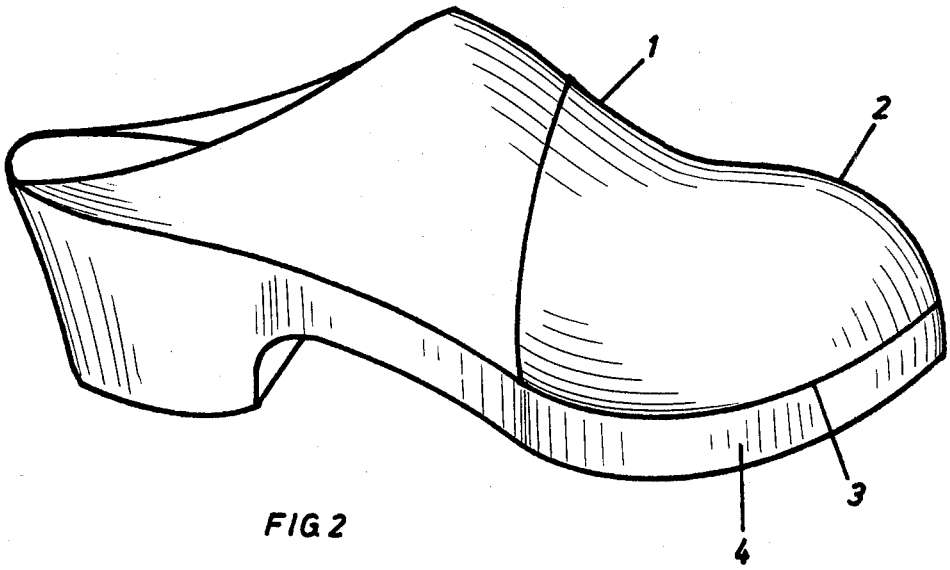
FIG. 2 shows the completed clog using the protector of FIG. 1, both being in a somewhat perspective side view.

Before describing the parts of the inventive protector in detail, it should be stated that the toe and inset protector according to FIG. 1 is particular suited to be used as an upper of a clog, as exemplified in FIG. 2. The safety clog thus achieved in fact provides more safety than shoes that only comprise a toe protector. Due to the special shape of the clog, the toe and instep protector according to this invention is especially suited as a front portion of the upper of the clog.

Because toe protectors made of steel are relatively heavy, it has been suggested to compensate this by making the soles of safety shoes from a less heavy material than before. However, this has resulted in materials that fail when stress acts on the shoe protector. The sole is usually bent upward in the middle when the toe protector is subjected to a load. Thus, the space at disposal for the front part of the foot is considerably reduced.

If it should, for example, be considered suitable to combine a wooden sole of a clog with an upper sole made of a material different from wood, the above disadvantage may be overcome by joining the foot protector with a base plate or the like, which could stiffen the sole in the area that is subjected to pressure. This is consequently another important aspect of the invention.

Figure 3:
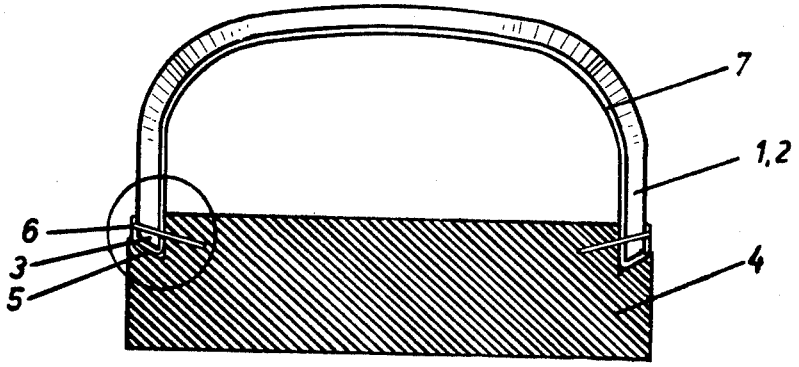
FIG. 3 is a vertical section taken through the toe portion of a safety clog according to the invention.
Figure 4:
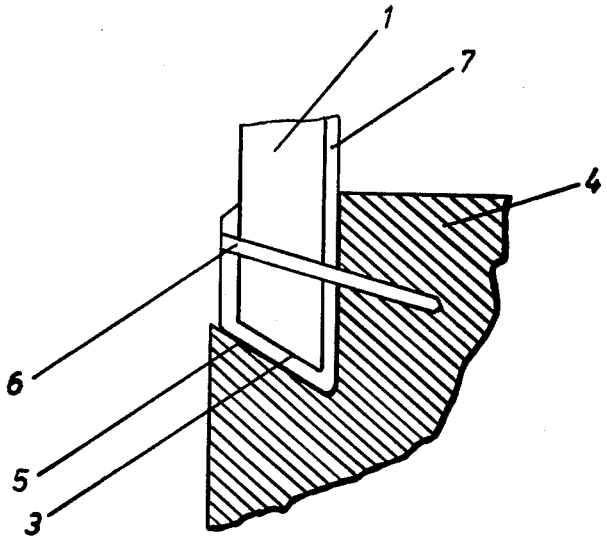
FIG. 4 is an enlarged sectional view of a detail of FIG. 3, circled therein at the left-hand side.

An important inventive feature of the foot protector according to the present invention is illustrated in FIGS. 3 and 4, the former being a related to a transversal section taken through the clog illustrated in FIG. 2.

Coming now to the structural details of the invention, the foot protector 1, 2 of FIG. 1 can be secured to a wooden sole 4. Around the sole 4 a groove 5 may be provided, as shown in FIG. 4 (omitted from FIGS. 2 and 3). The bottom of the groove 5 preferably forms an angle of 30° to 75° with the vertical lateral edge of the groove. A lower edge 3 of the foot protector is angled, this edge 3 being preferably adapted in its configuration to the groove 5.

In the preferred embodiment illustrated in FIGS. 3 and 4, the foot protector is provided with an inside lining 7 that can be folded about the lower edge 3 and extends a short distance upwards outside of the foot protector 1, 2. The protector is secured to the sole 4 e.g.

by rivets or nails 6. The groove 5 is preferably arranged in such a manner that the exterior lateral edge of the sole 4 extends somewhat outside the foot protector 1, 2 and the lining 7 that is attached thereto. According to another preferred embodiment, the lining may however be omitted.

The advantage of the above described embodiment is that a very strong and stable attachment of the foot protector is achieved on its sole. This is of the greatest importance when the clog is used for safety footwear.

It will be understood by those skilled in the art that the sole having been mentioned herein may be constituted by a separate plate and the like.

The so far described embodiment of the foot protector according to this invention, where the toe portion is linked or connected to the instep portion, is suited for use in safety footwear such as safety shoes, etc.

The connection between the portions of the foot protector can be arranged in any conventional manner that is suited for this purpose. In this manner, the toe cap will be movable, at least to a limited extent, in relation to the instep cap of the foot protector, and the latter will thus permit natural movement of the foot.

To prevent the lower edges of the foot protector from being impressed in the sole when exposed to high loads, that might considerably reduce the space available to the front part of the foot, the protector is preferably provided with a border, a base sheet or the like on its underside. In this manner, satisfactory rigidity is achieved in the area of the sole that is exposed to pressure.

Figure 5:
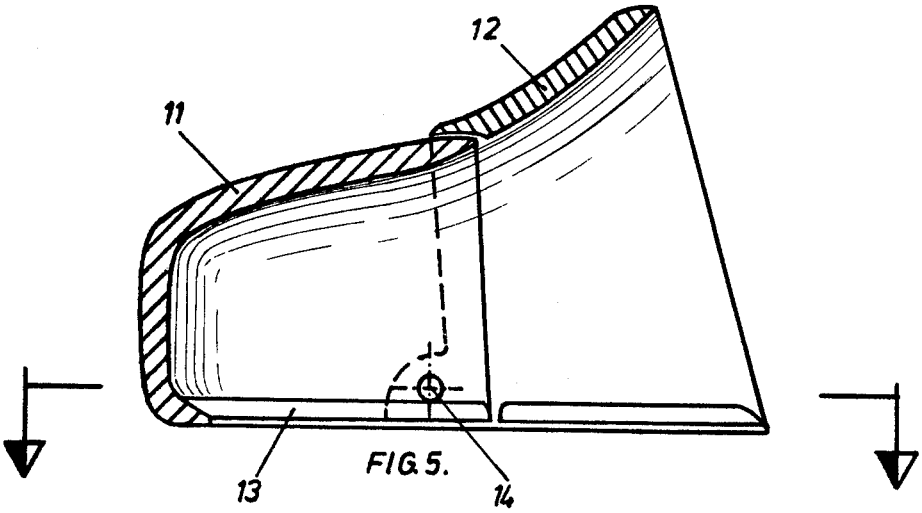
FIG. 5 is a substantially vertical section of a foot protector according to the invention.
Figure 6:
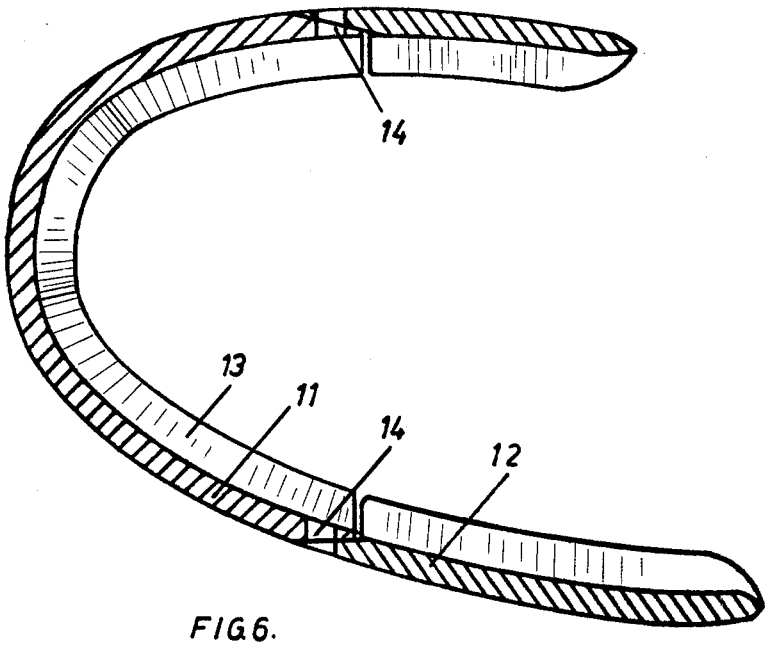
FIG. 6 is a horizontal section corresponding to FIG. 5, taken in the direction of the two large arrows in FIG. 5.

The second, preferred embodiment of the foot protector will now be described with reference to FIGS. 5 through 7. FIGS 5 and 6 show a vertical and a respective horizontal section through a foot protector where a toe cap 11 is hinged to an instep cap 12, for example by rivets passed through holes 14 on at least one side or both of the foot protector. The protector preferably includes a border 13, as shown.

Figure 7:
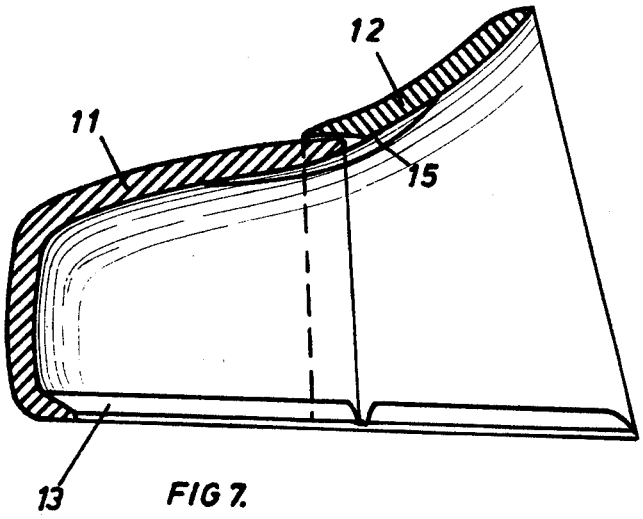
FIG. 7 is an alternative embodiment, otherwise similar to that of FIG. 5, also in vertical section.

FIG. 7 constitutes an alternative or modified embodiment of FIG. 5, also a vertical section, where the toe cap 11 is hinged to the instep cap 12 such as by an elastic material 15, made, for example, of rubber, secured to the caps, such as by an adhesive.

The foot protector according to the present invention has further advantages as regards the production of such safety footwear. By molding foot protectors according to the invention, they will have a uniform and quite exact shape. This is most advantageous when the protectors are incorporated or inserted in safety footwear, such as shoes or boots, since their fit will be very good.

Conventional toe protectors of steel are usually produced by stamping. Their shapes will, thus, be somewhat less uniform and exact, which results in problems when they are incorporated in safety footwear. Such problems are completely eliminated with the foot protector embodiments described according to the present invention.

It should be understood that modifications, additions and changes can, of course, be made in the disclosed preferred embodiments, limited only by the spirit and scope of the present invention.

What I claim is:

1. A foot protector in combination with footwear comprising a plastic material conforming to the shape of the toe and to the instep part of a foot and including a toe cap portion and an instep cap portion covering the entire instep of the foot, said toe cap portion and instep cap portion including lower parts extending to the sole of the footwear, said toe cap and instep cap portions being shaped to be secured to said footwear sole to prevent the foot protector from pressing against the foot or penetrating into the sole by application of high loads, said lower parts being shaped at an angle of 30° to 75° corresponding to a groove provided in said sole, the lower parts being attached to the sole by rivets or nails, the sole being of wood.

2. The combination as claimed in claim 1, wherein said cap portions are formed from a single piece of said plastic material.

3. The combination as claimed in claim 2, further comprising a lining covering the inside of said portions, and outside of the foot protector.

4. The combination as claimed in claim 3, wherein said lining consists of a leather material.

5. The foot protector as claimed in claim 1, wherein said plastic material is of the polycarbonate type.

* * * * *